US009164466B2

(12) United States Patent
Tano et al.

(10) Patent No.: US 9,164,466 B2
(45) Date of Patent: Oct. 20, 2015

(54) CLEANING BLADE, CLEANING DEVICE, AND IMAGE FORMING APPARATUS

(71) Applicant: FUJI XEROX CO., LTD., Tokyo (JP)

(72) Inventors: Daisuke Tano, Kanagawa (JP); Yu Nakamura, Kanagawa (JP); Masato Ono, Kanagawa (JP); Noriaki Kojima, Kanagawa (JP); Tsutomu Sugimoto, Kanagawa (JP); Hiroaki Akamatsu, Kanagawa (JP); Yoshinori Takahashi, Kanagawa (JP); Kei Tanaka, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/267,389

(22) Filed: May 1, 2014

(65) Prior Publication Data

US 2015/0177674 A1 Jun. 25, 2015

(30) Foreign Application Priority Data

Dec. 19, 2013 (JP) ..... 2013-262988

(51) Int. Cl.
*G03G 21/00* (2006.01)

(52) U.S. Cl.
CPC ..... *G03G 21/0017* (2013.01)

(58) Field of Classification Search
USPC ..... 399/350
See application file for complete search history.

(56) References Cited

U.S. PATENT DOCUMENTS

| | | | | |
|---|---|---|---|---|
| 4,639,471 | A * | 1/1987 | Hirai et al. | 521/172 |
| 6,316,586 | B1 * | 11/2001 | Sunkara et al. | 528/300 |
| 2002/0037990 | A1 | 3/2002 | Hitoshi et al. | |
| 2006/0004174 | A1 * | 1/2006 | Omori et al. | 528/44 |
| 2008/0242783 | A1 * | 10/2008 | Ganesan et al. | 524/413 |
| 2009/0041779 | A1 * | 2/2009 | Mitts et al. | 424/158.1 |
| 2010/0092222 | A1 * | 4/2010 | Chiba et al. | 399/350 |
| 2011/0021721 | A1 * | 1/2011 | Masumoto | 525/440.01 |
| 2012/0301197 | A1 * | 11/2012 | Ziegelmuller et al. | 399/350 |

FOREIGN PATENT DOCUMENTS

JP A-2005-182072 7/2005

* cited by examiner

*Primary Examiner* — WB Perkey
*Assistant Examiner* — Linda B Smith
(74) *Attorney, Agent, or Firm* — Oliff PLC

(57) ABSTRACT

A cleaning blade includes a portion which comes in contact with a member to be cleaned, and the portion is configured of a member containing polyurethane rubber having a structure derived from polyester polyol in which a first diol component having 10 or more carbon atoms and a second diol component having 5 or less carbon atoms are condensed with dicarboxylic acid at a molar ratio (first diol component/second diol component) of 50/50 to 80/20, a structure derived from polyisocyanate, and a structure derived from a triol.

11 Claims, 5 Drawing Sheets

CLEANING BLADE, CLEANING DEVICE, AND IMAGE FORMING APPARATUS

CROSS-REFERENCE TO RELATED APPLICATIONS

This application is based on and claims priority under 35 USC 119 from Japanese Patent Application No. 2013-262988 filed Dec. 19, 2013.

BACKGROUND

1. Technical Field

The present invention relates to a cleaning blade, a cleaning device, and an image forming apparatus.

2. Related Art

In the related art, in a copying machine, a printer, a facsimile and the like of an electrophotographic system, a cleaning blade has been used as a cleaning unit for removing toner or the like remaining on a surface of an image holding member such as a photoreceptor. The cleaning blade is not particularly limited thereto, and is used as a unit for cleaning surfaces of various members to be cleaned.

SUMMARY

According to an aspect of the invention, there is provided a cleaning blade wherein a portion which comes in contact with a member to be cleaned is configured of a member containing polyurethane rubber having a structure derived from polyester polyol in which a first diol component having 10 or more carbon atoms and a second diol component having 5 or less carbon atoms are condensed with dicarboxylic acid at a molar ratio (first diol component/second diol component) of 50/50 to 80/20, a structure derived from polyisocyanate, and a structure derived from a triol.

BRIEF DESCRIPTION OF THE DRAWINGS

Exemplary embodiments of the present invention will be described in detail based on the following figures, wherein.

DETAILED DESCRIPTION

Figure 1:
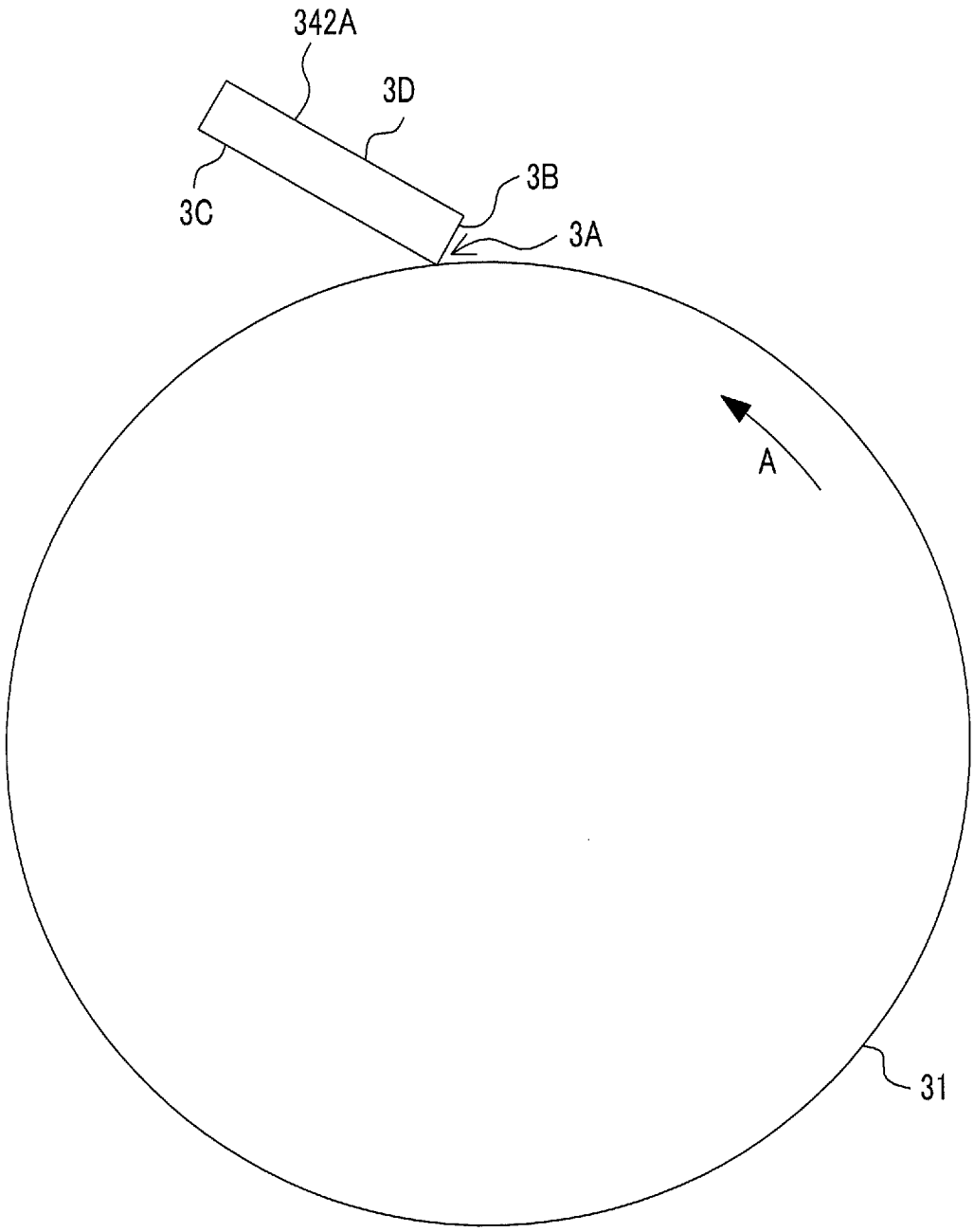
FIG. 1 is a schematic diagram showing an example of a cleaning blade of an exemplary embodiment.

Hereinafter, exemplary embodiments of a cleaning blade, a cleaning device, a process cartridge, and an image forming apparatus of exemplary embodiments of the invention will be described in detail.

Cleaning Blade

A portion of a cleaning blade according to the exemplary embodiment which comes in contact with a member to be cleaned, is configured of a member containing polyurethane having a structure derived from polyester polyol in which a first diol component having 10 or more carbon atoms and a second diol component having 5 or less carbon atoms are condensed with dicarboxylic acid at a molar ratio (first diol component/second diol component) of 50/50 to 80/20, a structure derived from polyisocyanate, and a structure derived from a triol.

The "structure derived from" means a structure in which molecules of a material used for synthesis of polyurethane are bonded to (added to or condensed with) molecules of other material, and then remains in a reaction product (polyurethane). Presence or absence of the structure derived from each material in polyurethane is analyzed by 1H-NMR (proton nuclear magnetic resonance) and gas chromatography mass spectrometer (GC-MS).

The cleaning blade is generally configured of rigid plate-shaped supporting material and a rubber elastic body, and urethane rubber is mainly used as the rubber elastic body as it has excellent abrasion resistance property, mechanical strength, oil resistance property, and ozone resistance property. As a polyurethane solution for forming urethane rubber, a mixture of a prepolymer formed of isocyanate and polyol, and a curing agent formed of polyol, a chain extender, and a catalyst, is generally used, and the mixture is injected into a centrifugal molding drum or a mold, and is heated and molded.

Since the cleaning blade used for an image forming apparatus or the like slides while coming in contact with a member to be cleaned (image holding member or the like), the contacting portion is gradually abraded, and the lifetime of the cleaning blade changes depending on the degree of the abrasion. Accordingly, an abrasion resistance property is required from a viewpoint of high durability. However, a required rubber property (strength) is not obtained when applying abrasion resistance properly to the cleaning blade, and as a result, cracks on the portion of the blade which comes in contact with the member to be cleaned (image holding member or the like) occur due to repeated use, in some cases. That is, it is difficult to satisfy both the abrasion resistance property and the strength (crack resistance property).

With respect to this, in the cleaning blade of the exemplary embodiment, polyurethane rubber configuring a contacting member includes polyester polyol which is obtained by condensing two kinds of diol components having the different number of carbon atoms with dicarboxylic acid at a specific molar ratio, as a structural component, and therefore the abrasion resistance property and the crack resistance property are satisfied. It is assumed that the abrasion resistance property and the crack resistance property are satisfied due to the following reasons.

It is considered that the first diol component having 10 or more carbon atoms is used at a specific molar ratio, and accordingly, a molecular movement property of polyol increases, a glass transition point decreases, a low-temperature property is improved, and the crack resistance property is improved due to high toughness.

In addition, it is considered that the second diol component having 5 or less carbon atoms is used at a specific molar ratio, and accordingly the molecular movement property of polyol decreases; a molecular cohesive force is improved, and therefore the mechanical strength (100% modulus) is improved; the blade is hardly distorted although the blade comes in contact with the member to be cleaned while applying pressure thereto, and thus a contacting area is hardly widened and abrasion is suppressed.

Next, a configuration of the cleaning blade of the exemplary embodiment will be described.

A member (hereinafter, referred to as a "contacting member") of the cleaning blade according to the exemplary embodiment which comes in contact with a member to be cleaned may be configured of a member containing polyurethane having a structure derived from polyester polyol in which a first diol component having 10 or more carbon atoms and a second diol component having 5 or less carbon atoms are condensed with dicarboxylic acid at a molar ratio (first diol component/second diol component) of 50/50 to 80/20, a structure derived from polyisocyanate, and a structure derived from a triol.

For example, the cleaning blade may have a two-layer configuration in which a first layer which is formed of the contacting member and comes in contact with a surface of a member to be cleaned and a second layer as a rear surface layer on the back of the first layer are provided, or may have a three or more layered configuration. In addition, the cleaning blade may have a configuration in which only a corner portion of the portion which comes in contact with the member to be cleaned is formed of the contacting member and the surrounding portion thereof is formed of another material.

Next, the configuration of the cleaning blade of the exemplary embodiment will be described in detail with reference to the drawings.

Figure 2:
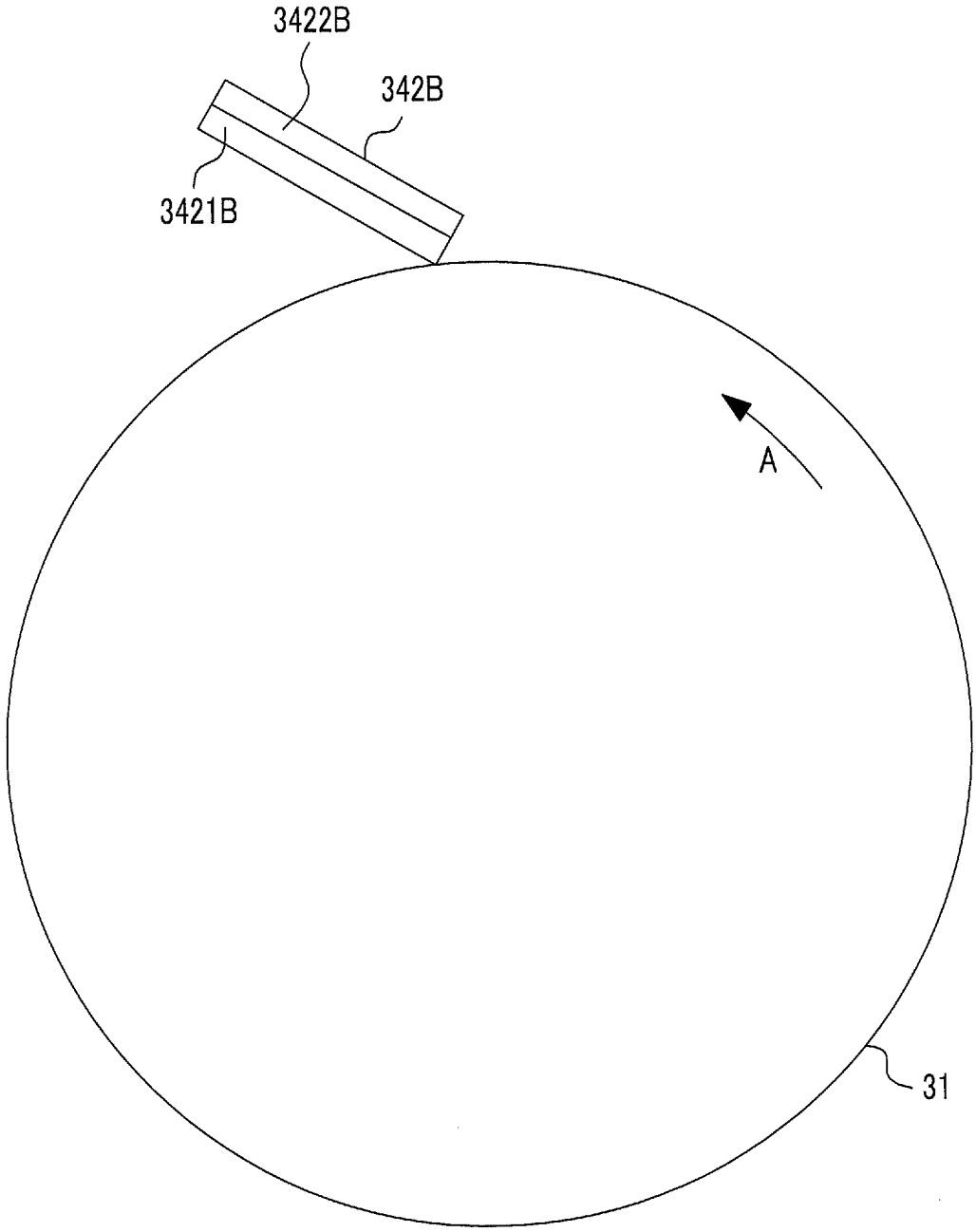
FIG. 2 is a schematic view showing another example of a cleaning blade of an exemplary embodiment.
Figure 3:
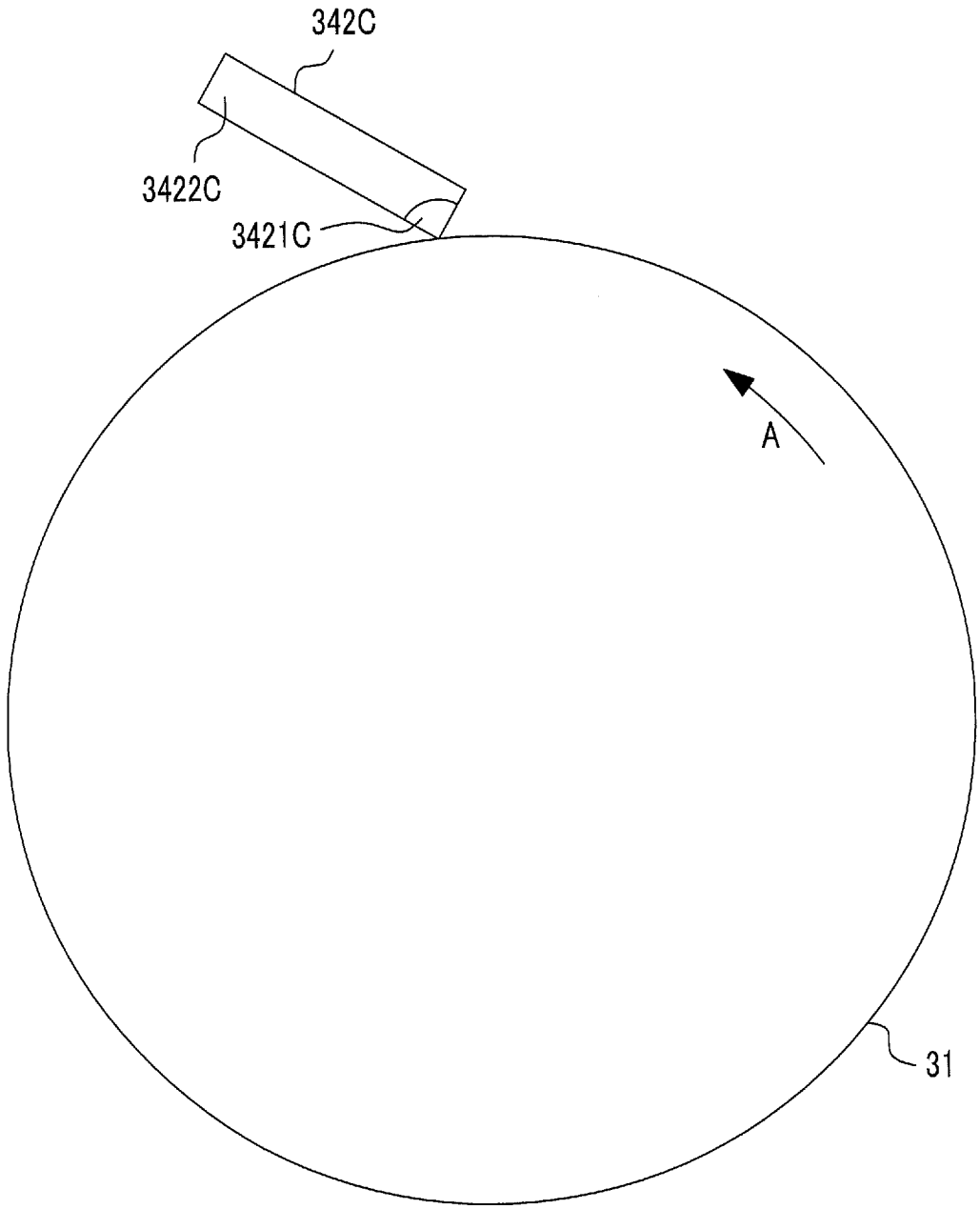
FIG. 3 is a schematic view showing still another example of a cleaning blade of an exemplary embodiment.

FIG. 1 is a schematic view showing a cleaning blade according to a first exemplary embodiment and a view showing a state where the cleaning blade comes in contact with a surface of a member to be cleaned (for example, image holding member). In addition, FIG. 2 is a view showing a state where a cleaning blade according to a second exemplary embodiment comes in contact with a surface of a member to be cleaned (for example, image holding member). FIG. 3 is a view showing a state where a cleaning blade according to a third exemplary embodiment comes in contact with a surface of a member to be cleaned (for example, image holding member).

First, each portion of the cleaning blade will be described with reference to FIG. 1. Hereinafter, as shown in FIG. 1, the cleaning blade includes a contacting portion (contacting corner portion) 3A which comes in contact with a driving image holding member (a photoreceptor drum) 31 to clean the surface of the image holding member 31, a tip surface 3B which configures one side with the contacting corner portion 3A and faces the upstream side of the driving direction (arrow A direction), a ventral surface 3C which configures one side with the contacting corner portion 3A and faces the downstream side of the driving direction (arrow A direction), and a rear surface 3D which shares one side with the tip surface 3B and opposes the ventral surface 3C.

In addition, a direction parallel to the contacting corner portion 3A is set as a depth direction, a direction from the contacting corner portion 3A to a side where the tip surface 3B is formed is set as a thickness direction, and a direction from the contacting corner portion 3A to a side where the ventral surface 3C is formed is set as a width direction.

The entirety of a cleaning blade 342A according to the first exemplary embodiment shown in FIG. 1 including the portion (contacting corner portion) 3A which comes in contact with the photoreceptor drum 31 is configured of single material, that is to say, the cleaning blade is formed of only the contacting member.

In addition, as the second exemplary embodiment shown in FIG. 2, the cleaning blade according to the exemplary embodiment may be a cleaning blade 342B having a two-layer configuration in which a first layer 3421B which includes the portion (contacting corner portion) 3A which comes in contact with the photoreceptor drum 31, is formed over the entire surface of the ventral surface 3C side, and is formed of the contacting member, and a second layer 3422B as a rear surface layer which is formed on the rear surface 3D side with respect to the first layer and is formed of a material different from the contacting member are provided.

Further, as a third exemplary embodiment shown in FIG. 3, the cleaning blade according to the exemplary embodiment may be a cleaning blade 342C having a configuration in which a contacting member (edge member) 3421C formed of a contacting member which includes the portion which comes in contact with the photoreceptor drum 31, that is, the contacting corner portion 3A, has a shape obtained by elongating ¼-cut of a cylinder in the depth direction, and includes a right angular portion of the shape forming the contacting corner portion 3A, and a rear surface member 3422C formed of a material different from the contacting member which covers the rear surface 3D side of the contacting member 3421C in the thickness direction and the side opposite the tip surface 3B in the width direction, that is, configures the portion other than the contacting member 3421C, are provided.

In FIG. 3, the member having a shape of ¼-cut of a cylinder is used as an example of the contacting member; however, it is not limited thereto. The contacting member, for example, may have a shape of ¼-cut of an elliptical cylinder, a square pole, or a rectangular pole.

In addition, the cleaning blade is generally used by being adhered to a rigid plate-shaped supporting material.

Composition of Contacting Member

The contacting member of the cleaning blade of the exemplary embodiment is configured to include polyurethane rubber.

Polyurethane Rubber

The polyurethane rubber has a structure derived from polyester polyol in which a first diol component having 10 or more carbon atoms and a second diol component having 5 or less carbon atoms are condensed with dicarboxylic acid at a molar ratio (first diol component/second dial component) of 50/50 to 80/20, a structure derived from polyisocyanate, and a structure derived from a triol. The polyurethane rubber may be polyurethane rubber obtained by polymerizing a resin including a functional group which may react with an isocyanate group of polyisocyanate other than a polyol component, if necessary.

It is preferable that the polyurethane rubber include hard segments and soft segments. Herein, the "hard segments" and the "soft segments" mean segments which are configured of a material configuring the former which is relatively harder than a material configuring the latter, and a material configuring the latter which is relatively softer than a material configuring the former, in the polyurethane rubber materials.

As a material (hard segment material) configuring the hard segments, polyisocyanate, a chain extender (for example, a diol or the like), a resin including a functional group which may react with an isocyanate group, and the like are used.

Meanwhile, as a material (soft segment material) configuring the soft segments, polyester polyol obtained by performing dehydration condensation of a first diol component having 10 or more carbon atoms and a second diol component having 5 or less carbon atoms with dicarboxylic acid, a cross-linking agent (triol), and the like are used.

Polyester Polyol Component

As a polyester polyol component configuring polyurethane rubber, polyester polyol obtained by condensing a first diol component having 10 or more carbon atoms and a second diol component having 5 or less carbon atoms with dicarboxylic acid at a molar ratio (first diol component/second diol component) of 50/50 to 80/20, is used. The molar ratio (first diol component/second diol component) of the first diol component to the second diol component to be reacted with dicarboxylic acid, is preferably from 50/50 to 70/30 and more preferably from 50/50 to 65/35, from a viewpoint of improvement of a crack resistance property.

In addition, a number average molecular weight of polyester polyol is preferably from 1,000 to 5,000 and more preferably from 1,000 to 3,000.

Dicarboxylic Acid

Examples of dicarboxylic acid used in synthesis of polyester polyol include oxalic acid, malonic acid, succinic acid, methylmalonic acid, glutaric acid, ethylmalonic acid, methylsuccinic acid, adipic acid, propylmalonic acid, ethylsuccinic acid, dimethylsuccinic acid, pimelic acid, butylmalonic acid, diethylmalonic acid, propylsuccinic acid, suberic acid, azelaic acid, sebacic acid, undecanedioic acid, dodecanedioic acid, phthalic acid, decamethylenedicarboxylic acid, and the like. Among them, succinic acid, adipic acid, sebacic acid, decamethylenedicarboxylic acid, and phthalic acid are preferable.

Dicarboxylic acid may be used alone or in combination of two or more kinds.

First Diol

The first diol used in synthesis of polyester polyol is a diol having 10 or more carbon atoms, and examples thereof include 1,10-decanediol, 1,11-undecanediol, 1,12-dodecanediol, 1,13-tridecanediol, 1,14-tetradecanediol, and the like.

The number of carbon atoms of the first diol is preferably equal to or less than 15 and more preferably equal to or less than 12, from viewpoints of availability and cost. Specifically, 1,10-decanediol, 1,11-undecanediol, and 1,12-dodecanediol are preferable.

As the first diol, a diol having 10 or more carbon atoms may be used alone or in combination of two or more kinds.

Second Diol

The second diol used in synthesis of polyester polyol is a diol having 5 or less carbon atoms, and examples thereof include ethylene glycol, 1,3-propanediol, 1,4-butanediol, 1,5-pentanediol, and the like.

The number of carbon atoms of the second diol is preferably from 2 to 4 in a viewpoint of improvement of a crack resistance property, and specifically, 1,2-ethanediol (ethylene glycol), 1,3-propanediol, and 1,4-butanediol are preferable.

As the second diol, a diol having 5 or less carbon atoms may be used alone or in combination of two or more kinds.

A polymerization ratio of polyester polyol component may be from 45 mol % to 90 mol % and is preferably from 50 mol % to 85 mol %, with respect to entire polymerization components of polyurethane rubber.

Polyisocyanate Component

Examples of polyisocyanate component configuring polyurethane rubber include 4,4'-diphenylmethane diisocyanate (MDI), 2,6-toluene diisocyanate (TDI), 1,6-hexane diisocyanate (HDI), 1,5-naphthalene diisocyanate (NDI), 3,3-dimethylphenyl-4,4-diisocyanate (TODI), and the like.

As the polyisocyanate component, 4,4'-diphenylmethane diisocyanate (MDI), 1,5-naphthalene diisocyanate (NDI), and 1,6-hexane diisocyanate (HDI) are preferable.

The polyisocyanate component may be used alone or in combination of two or more kinds.

A polymerization ratio of the polyisocyanate component may be from 5 mol % to 30 mol % and is preferably from 8 mol % to 20 mol %, with respect to entire polymerization components of polyurethane rubber.

Cross-Linking Agent

As a cross-linking agent, a diol (bifunction), a triol (trifunction), a tetraol (tetrafunction), or the like is used, and these may be used in combination. In addition, an amine-based compound may be used as a cross-linking agent. Further, a tri- or higher-functional cross-linking agent is preferable to be used as a cross-linking agent.

The trifunctional cross-linking agent is not particularly limited, for example, trimethylolpropane, glycerin, tri-isopropanolamine and the like are used. By performing cross-linking using the trifunctional cross-linking agent described above, compression characteristics and impact resilience of polyurethane are further improved.

Blending quantity of the cross-linking agent is preferably less than 2 parts by weight with respect to the polyester polyol component. If the blending quantity of the cross-linking agent is less than 2 parts by weight, molecular motion is not restrained due to chemical crosslink, hard segment derived from urethane bonding due to aging grows large, and sufficient hardness is easily obtained.

Chain Extender

As the chain extender, a diol or a diamine having weight-average molecular weight (Mw) of less than 400 may be used, and 1,4-butanediol is used, for example.

Blending quantity of the chain extender is preferably equal to or less than 20 parts by weight with respect to the polyester polyol component.

Method of Manufacturing Polyurethane Rubber

For manufacture of the polyurethane rubber configuring the contacting member of the cleaning blade of the exemplary embodiment, a general method of manufacturing the polyurethane such as a prepolymer method or a one-shot method is used. Since polyurethane having excellent strength and abrasion resistance property is obtained, the prepolymer method is preferable for the exemplary embodiment; however the exemplary embodiment is not limited by the method of manufacturing.

In addition, the molding of the cleaning blade is performed by forming a composition for cleaning blade formation prepared by the method described above in a sheet shape and performing a cut process and the like, using centrifugal molding or extrusion molding.

Herein, as the catalyst used in the manufacture of polyurethane rubber, an amine-based compound such as a tertiary amine, a quaternary ammonium salt, an organic metal compound such as an organic tin compound or the like is used.

Examples of the tertiary amine include trialkyl amine such as triethyl amine, tetraalkyl diamine such as N,N,N',N'-tetramethyl-1,3-butane diamine, aminoalcohol such as dimethylethanol amine, ethoxylated amine, ethoxylated diamine, ester amine such as bis (diethyl ethanol amine) adipate, triethylenediamine (TEDA), cyclohexylamine derivative such as N,N-dimethyl cyclohexylamine, morpholine derivative such as N-methylmorpholine or N-(2-hydroxypropyl)-dimethylmorpholine, or piperazine derivative such as N,N'-diethyl-2-methyl-piperazine or N,N'-bis-(2-hydroxypropyl)-2-methylpiperazine, and the like.

Examples of the quaternary ammonium salt include 2-hydroxypropyl trimethyl ammonium octylate, 1,5-diazabicyclo[4.3.0]nonene-5 (DBN).octylate, 1,8-diazabicyclo[5.4.0]undecene-7 (DBU).octylate, DBU-oleate, DBU-p-toluene sulfonate, DBU-formate, or 2-hydroxypropyl trimethyl ammonium.formate, and the like.

Examples of the organic tin compound include a dialkyl tin compound such as dibutyl tin dilaurate or dibutyl tin di(2-ethylhexoate), stannous 2-ethyl caproate, stannous oleate, and the like.

Among the catalysts, triethylenediamine (TEDA) which is a tertiary ammonium salt is used from a viewpoint of hydrolysis resistance, and quaternary ammonium salts are suitably used from a viewpoint of processability. Among the quaternary ammonium salts, 1,5-diazabicyclo[4.3.0]nonene-5

(DBN). octylate, 1,8-diazabicyclo[5.4.0]undecene-7 (DBU).octylate, and DBU-formate having high reactivity are suitably used.

Content of the catalyst is preferably in a range from 0.0005% by weight to 0.03% by weight, and is particularly preferably from 0.001% by weight to 0.01% by weight, with respect to the entire polyurethane rubber configuring the contacting member.

The catalyst is used alone or in combination of two or more kinds.

A polyurethane rubber member is molded by blending the isocyanate compound, the cross-linking agent, the catalyst and the like to polyester polyol described above under molding conditions to suppress unevenness of molecular arrangement.

In detail, when preparing a composition for forming polyurethane, adjustment is performed by setting a temperature of polyester polyol or a prepolymer low or setting a temperature of curing and molding low so that the crosslink proceeds slowly. If the temperatures (temperature of polyester polyol or a prepolymer and temperature of curing and molding) are set low, a reactive property is decreased, and accordingly the urethane bonding portion is aggregated, and a crystalline member thereof is obtained.

In addition, the amounts of polyester polyol, polyisocyanate, and the cross-linking agent, a ratio of the cross-linking agent, and the like are adjusted within a desired range.

Physical Properties of Contacting Member

100% modulus of the contacting member (polyurethane member) of the cleaning blade of the exemplary embodiment is preferably equal to or greater than 6 MPa, and a Tan 8 peak temperature thereof is preferably equal to or lower than 0° C.

Herein, the 100% modulus and the Tan δ peak temperature are values measured in "Examples" which will be described later.

100% Modulus (Stress at a Given Elongation)

The 100% modulus (M100 [MPa]) of the contacting member (polyurethane rubber member) is preferably equal to or greater than 6 MPa, more preferably from 6.5 MPa to 8 MPa, and even more preferably from 7 MPa to 8.5 MPa, from viewpoints of an abrasion resistance property and a crack resistance property.

It is suitable to set the 100% modulus of the contacting member (polyurethane rubber member) to be equal to or greater than 6 MPa, since an abrasion resistance property and a crack resistance property increase.

Tan δ Peak Temperature

The Tan δ peak temperature [° C.] of the contacting member (polyurethane rubber member) is preferably equal to or lower than 0° C., more preferably from −30° C. to −1° C., and even more preferably from −15° C. to −5° C.

It is suitable to set the Tan δ peak temperature [° C.] of the contacting member (polyurethane rubber member) to be equal to or lower than 0° C., since an abrasion resistance property and a crack resistance property increase.

Herein, in order to set the Tan δ peak temperature [° C.] of the contacting member (polyurethane rubber member) to be equal to or lower than 0° C., that is, to shift the temperature to a negative (−) side, 1) a method of using polytetramethylene ether glycol having a high number average molecular weight, 2) a method of increasing used amount (polymerization ratio) of polytetramethylene ether glycol, or the like is used.

In addition, by also using 1) a method of increasing a molding temperature of the contacting member (polyurethane rubber member) to promote chemical crosslink, and 2) a method of performing aging at a high temperature after performing molding of the contacting member (polyurethane rubber member), growth of hard segment aggregates in the polyurethane rubber is suppressed, and accordingly the Tan δ peak temperature [° C.] of the contacting member (polyurethane rubber member) is easily controlled to be equal to or lower than 0° C.

Hardness

Hardness (JIS-A) of the contacting member (polyurethane rubber member) may be from 60° to 90° and is preferably from 70° to 80°, from viewpoints of an abrasion resistance property and a crack resistance property.

Impact Resilience Modulus

A impact resilience modulus (Re [%]) of the contacting member (polyurethane rubber member) may be from 28% to 60% and is preferably from 30% to 40%, from viewpoints of an abrasion resistance property and a crack resistance property.

Weight-Average Molecular Weight

Weight-average molecular weight of the contacting member (polyurethane rubber member) may be from 1,000 to 4,000 and is preferably from 1,500 to 3,500.

Composition of Non-Contacting Member

Next, a composition of a non-contacting member in a case where the contacting member and a region other than the contacting member (non-contacting member) of the cleaning blade of the exemplary embodiment are configured of materials different from each other, as in a second exemplary embodiment shown in FIG. 2 or in a third exemplary embodiment shown in FIG. 3, will be described.

The non-contacting member is not particularly limited and any well-known material may be used as long as it has a function of supporting the contacting member. Specifically, examples of the material used for the non-contacting member include polyurethane rubber, silicon rubber, fluoro-rubber, chloroprene rubber, butadiene rubber, and the like. Among them, polyurethane rubber is preferable. As the polyurethane rubber, ester-based polyurethane and ether-based polyurethane are used, and ester-based polyurethane is particularly preferable.

Manufacture of Cleaning Blade

In a case of the cleaning blade formed of only the contacting member shown in FIG. 1, the cleaning blade is manufactured by the molding method of the contacting member described above.

In addition, in a case of the cleaning blade having the multiple-layer configuration such as the two-layer configuration shown in FIG. 2, the cleaning blade is manufactured by bonding the first layer as the contacting member and a second layer as the non-contacting member (plural layers in a case of a layer configuration with three layers or more), to each other. As the bonding method, double-sided tape, various adhesive agents or the like are suitably used. In addition, the plural layers may be adhered to each other by pouring materials of each layer into a mold with a time difference when molding and bonding each material to each other without providing adhesive layers.

In a case of a configuration including the contacting member (edge member) and the non-contacting member (rear surface member) shown in FIG. 3, a first mold including a cavity (a region in which a composition for formation of the contacting member is poured) corresponding to a semicircular columnar shape which is obtained by overlapping the ventral surface 3C sides of two contacting members 3421C shown in FIG. 3 with each other, and a second mold including a cavity corresponding to a shape obtained by overlapping the ventral surface 3C sides of two of each contacting member 3421C and non-contacting member 3422C with each other, are prepared. A first molded material having a shape obtained by overlapping two contacting members 3421C with each other is formed by pouring the composition for formation of the contacting member into the cavity of the first mold and curing it. Then, after extracting the first mold, the second mold is installed so as to dispose the first molded material inside the cavity of the second mold. Next, a second molded material having a shape obtained by overlapping the ventral surface 3C sides of two of each contacting member 3421C and non-contacting member 3422C with each other, is formed by pouring a composition for formation of the non-contacting member into the cavity of the second mold so as to cover the first molded material and curing it. Then, the center of the formed second molded material, that is, the portion to be the ventral surface 3C, is cut, the center of the contacting member with a semicircular columnar shape is segmented and cut so as to be a shape of ¼-cut of a cylinder, and further cut to obtain a predetermined dimension, and thus, the cleaning blade shown in FIG. 3 is obtained.

Purpose of Cleaning Blade

When cleaning the member to be cleaned using the cleaning blade of the exemplary embodiment, the member to be cleaned which is the target for cleaning is not particularly limited as long as it is a member, a surface of which is necessary to be cleaned in the image forming apparatus. For example, an intermediate transfer medium, a charging roller, a transfer roller, a transfer medium transporting belt, a paper transporting roller, a detoning roller for further removing toner from a cleaning brush for removing toner from an image holding member, and the like are used; however, in the exemplary embodiment, the image holding member is particularly preferably used. The cleaning blade of the exemplary embodiment may clean a member other than the member for the image forming apparatus, as the member to be cleaned.

Cleaning Device, Process Cartridge and Image Forming Apparatus

Next, a cleaning device, a process cartridge, and an image forming apparatus used with the cleaning blade of the exemplary embodiment will be described.

The cleaning device of the exemplary embodiment is not particularly limited as long as it includes the cleaning blade of the exemplary embodiment as a cleaning blade which comes in contact with a surface of a member to be cleaned and cleans the surface of the member to be cleaned. For example, a configuration example of the cleaning device includes, a configuration, in which the cleaning blade is fixed so that an edge tip faces an opening portion side in a cleaning case including an opening portion on a side of the member to be cleaned and a transporting member which guides foreign materials such as waste toner collected from the surface of the member to be cleaned by the cleaning blade to a foreign material collecting container is included. In addition, two or more cleaning blades of the exemplary embodiment may be used in the cleaning device of the exemplary embodiment.

In a case of using the cleaning blade of the exemplary embodiment to clean the image holding member, in order to suppress an image deletion when forming an image, Normal Force (NF), which is a force to press the cleaning blade against the image holding member, is preferably in a range from 1.3 gf/mm to 2.3 gf/mm and more preferably in a range from 1.6 gf/mm to 2.0 gf/mm.

In addition, a length of a tip portion of the cleaning blade held in the image holding member is preferably in a range from 0.8 mm to 1.2 mm and more preferably in a range from 0.9 mm to 1.1 mm.

Working Angle (W/A), which is an angle of the contacting portion of the cleaning blade and the image holding member is preferably in a range from 8° to 14° and more preferably in a range from 10° to 12°.

Meanwhile, the process cartridge of the exemplary embodiment is not particularly limited as long as it includes the cleaning device of the exemplary embodiment as the cleaning device which comes in contact with surfaces of one or more members to be cleaned such as the image holding member, the intermediate transfer medium, and the like and cleans the surfaces of the members to be cleaned, and for example, a process cartridge that includes the image holding member and the cleaning device of the exemplary embodiment which cleans the surface of the image holding member and that is detachable from the image forming apparatus, is used. For example, if it is a so-called tandem machine including the image holding member corresponding to toner of each color, the cleaning device of the exemplary embodiment may be provided for each image holding member. In addition, a cleaning brush or the like may be used in combination, in addition to the cleaning device of the exemplary embodiment.

Specific Examples of Cleaning Blade, Image Forming Apparatus, and Cleaning Device Next, specific examples of the cleaning blade of the exemplary embodiment, and the image forming apparatus and the cleaning device using the cleaning blade will be described with reference to the drawing.

Figure 4:
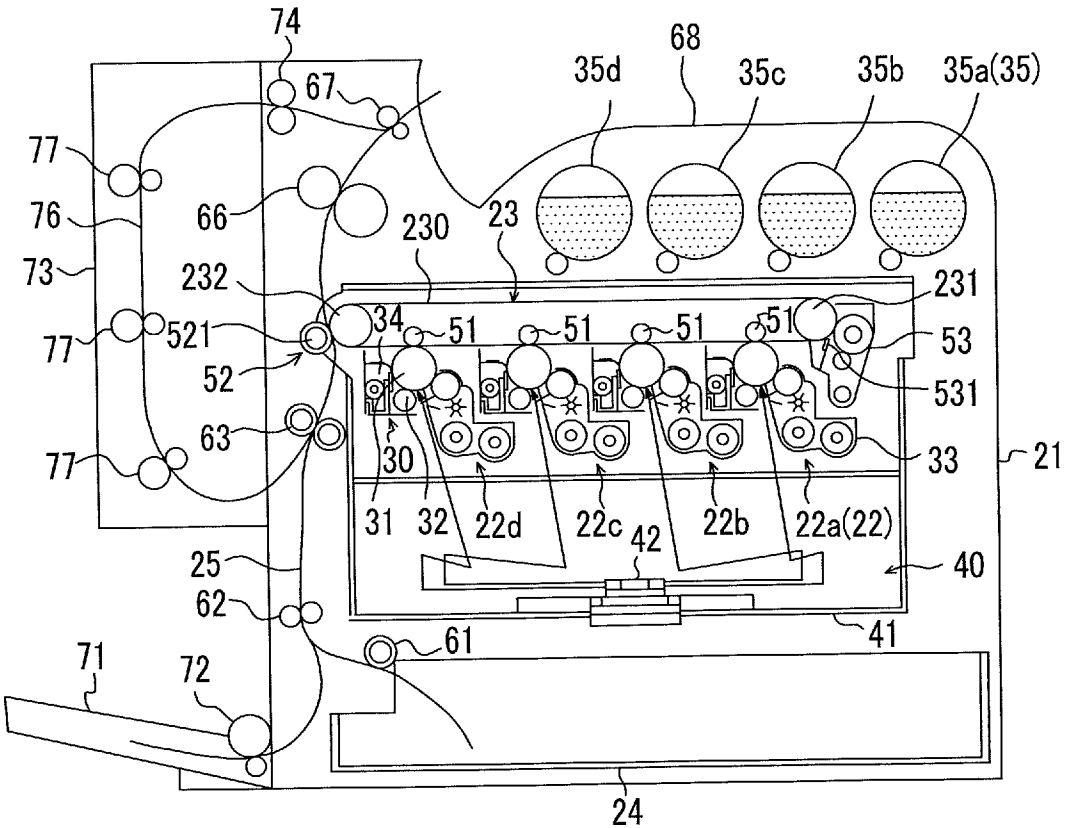
FIG. 4 is a perspective schematic view showing an example of an image forming apparatus according to an exemplary embodiment.

FIG. 4 is a perspective schematic view showing an example of the image forming apparatus of the exemplary embodiment, and shows a so-called tandem type image forming apparatus.

In FIG. 4, reference numeral 21 denotes a main member housing, reference numerals 22 and 22*a* to 22*d* denote image forming units, reference numeral 23 denotes a belt module, reference numeral 24 denotes a recording medium supply cassette, reference numeral 25 denotes a recording medium feeding path, reference numeral 30 denotes each photoreceptor unit, reference numeral 31 denotes a photoreceptor drum, reference numeral 33 denotes each developing unit, reference numeral 34 denotes a cleaning device, reference numerals 35 and 35*a* to 35*d* denote toner cartridges, reference numeral 40 denotes an exposing unit, reference numeral 41 denotes a unit case, reference numeral 42 denotes a polygon mirror, reference numeral 51 denotes a primary transfer unit, reference numeral 52 denotes a secondary transfer unit, reference numeral 53 denotes a belt cleaning device, reference numeral 61 denotes a sending-out roller, reference numeral 62 denotes a feed roll, reference numeral 63 denotes a positioning roller, reference numeral 66 denotes a fixing device, reference numeral 67 denotes a discharge roll, reference numeral 68 denotes a discharge unit, reference numeral 71 denotes a manual feeder, reference numeral 72 denotes a sending-out roller, reference numeral 73 denotes a double side recording unit, reference numeral 74 denotes a guide roller, reference numeral 76 denotes a feeding path, reference numeral 77 denotes a feed roll, reference numeral 230 denotes an intermediate transfer belt, reference numerals 231 and 232 denote support rollers, reference numeral 521 denotes a secondary transfer roller, and reference numeral 531 denotes a cleaning blade.

In the tandem type image forming apparatus shown in FIG. 4, the image forming units 22 (in detail, 22*a* to 22*d*) with four colors (in the exemplary embodiment, yellow, magenta, cyan, and black) are arranged in the main member housing 21, and on the upper portion thereof, the belt module 23 including the intermediate transfer belt 230 which is circulation-transported along an arrangement direction of each image forming unit 22, is disposed. Meanwhile, the recording medium supply cassette 24, in which a recording medium (not shown) such as paper, is accommodated, is disposed on the lower portion of the main member housing 21, and the recording medium feeding path 25, which is a feeding path of the recording medium from the recording medium supply cassette 24, is disposed in a vertical direction.

In the exemplary embodiment, image forming units 22 (22*a* to 22*d*) form toner images for yellow, magenta, cyan, and black (arrangement is not particularly limited to this order), in order from upstream in a circulation direction of the intermediate transfer belt 230, and include each photoreceptor unit 30, each developing unit 33, and one common exposing unit 40.

Herein, each photoreceptor unit 30 includes, for example, the photoreceptor drum 31, a charging device (charging roller) 32 which charges the photoreceptor drum 31 in advance, and the cleaning device 34 which removes toner remaining on the photoreceptor drum 31 integrally as a sub-cartridge.

In addition, the developing units 33 develop an electrostatic latent image formed by exposing in the exposing unit 40 on the charged photoreceptor drum 31 with the corresponding color toner (in the exemplary embodiment, for example, negative polarity), and configures the process cartridge (so-called customer replaceable unit) by being integrated with the sub-cartridge formed of the photoreceptor unit 30, for example.

Further, the process cartridge may also be used alone by separating the photoreceptor unit 30 from the developing unit 33. In addition, in FIG. 4, reference numerals 35 (35*a* to 35*d*) are toner cartridges (toner supplying path is not shown) for supplying each color component toner to each developing unit 33.

Meanwhile, the exposing unit 40 is disposed to accommodate, for example, four semiconductor lasers (not shown), one polygon mirror 42, an imaging lens (not shown), and each mirror (not shown) corresponding to each photoreceptor unit 30 in the unit case 41, to scan light from the semiconductor laser for each color component with deflection by the polygon mirror 42, and to guide an optical image to an exposing point on the corresponding photoreceptor drum 31 through the imaging lens and mirrors.

In addition, in the exemplary embodiment, the belt module 23 includes the intermediate transfer belt 230 to bridge a pair of support rollers (one roller is a driving roller) 231 and 232, and each primary transfer unit (in this example, primary transfer roller) 51 is disposed on the back surface of the intermediate transfer belt 230 corresponding to the photoreceptor drum 31 of each photoreceptor unit 30. By applying a voltage having polarity reversed with charging polarity of toner to the primary transfer unit 51, the toner image on the photoreceptor drum 31 is electrostatically transferred to the intermediate transfer belt 230 side. Further, the secondary transfer unit 52 is disposed on a portion corresponding to the support roller 232 on the downstream of the image forming unit 22*d* which is on the most downstream of the intermediate transfer belt 230, and performs secondary transfer (collective transfer) of the primary transfer image on the intermediate transfer belt 230 to a recording medium.

In the exemplary embodiment, the secondary transfer unit 52 includes the secondary transfer roller 521 which is disposed in press-contact on the toner image holding surface side of the intermediate transfer belt 230, and a back surface roller (in this example, also used as the support roller 232) which is disposed on the rear surface side of the intermediate transfer belt 230 to be formed as a counter electrode of the secondary transfer roller 521. In addition, for example, the secondary transfer roller 521 is grounded, and bias having the same polarity as the charging polarity of the toner is applied to the back surface roller (support roller 232).

Further, the belt cleaning device 53 is disposed on the upstream side of the image forming unit 22*a* which is on the most upstream of the intermediate transfer belt 230, and removes the remaining toner on the intermediate transfer belt 230.

In addition, the sending-out roller 61 which sends out a recording medium is disposed on the recording medium supply cassette 24, the feed roll 62 which sends out the recording medium is disposed right behind the sending-out roller 61, and a registration roller (positioning roller) 63 which supplies the recording medium to the secondary transfer portion at a predetermined timing is disposed on the recording medium feeding path 25 positioned right in front of the secondary transfer portion. Meanwhile, the fixing device 66 is disposed on the recording medium feeding path 25 positioned on the downstream of the secondary transfer portion, the discharge roll 67 for discharge of the recording medium is disposed on downstream of the fixing device 66, and a discharged recording medium is accommodated in the discharge unit 68 formed on the upper portion of the main member housing 21.

In addition, in the exemplary embodiment, the manual feeder (MSI) 71 is disposed on the side of the main member housing 21, and the recording medium on the manual feeder 71 is sent towards the recording medium feeding path 25 through the sending-out roller 72 and the feed roll 62.

Further, the double side recording unit 73 is supplemented in the main member housing 21. When a double side mode for performing image recording on both sides of a recording medium is selected, the double side recording unit 73 reverses a recording medium with the single side recorded by the discharge roll 67, brings the recording medium to the inner portion through the guide roller 74 in front of an inlet, transports the recording medium along the recording medium feeding back path 76 provided therein through the feed rolls 77, and supplies the recording medium to the positioning roller 63 side again.

Next, the cleaning device 34 disposed in the tandem type image forming apparatus shown in FIG. 4 will be described in detail.

Figure 5:
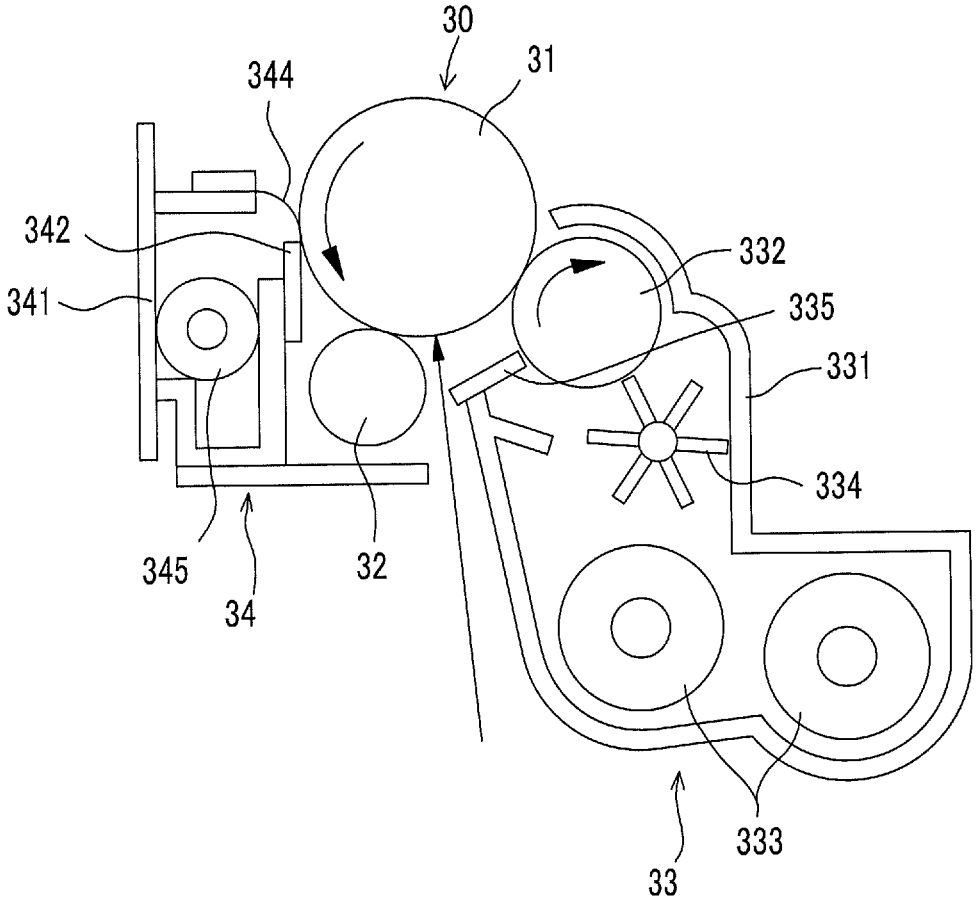
FIG. 5 is a schematic cross-sectional view showing an example of a cleaning device according to an exemplary embodiment.

FIG. 5 is a schematic cross-sectional view showing an example of the cleaning device of the exemplary embodiment, and is a view showing the cleaning device 34, the photoreceptor drum 31, the charging roller 32, and the developing unit 33 as the sub-cartridge, shown in FIG. 4.

In FIG. 5, reference numeral 32 denotes the charging roller (charging device), reference numeral 331 denotes a unit case, reference numeral 332 denotes a developing roller, reference numerals 333 denote toner transporting members, reference numeral 334 is a transporting paddle, reference numeral 335 is a developer quantity regulating member, reference numeral 341 denotes a cleaning case, reference numeral 342 denotes a cleaning blade, reference numeral 344 denotes a film seal, and reference numeral 345 denotes a transporting member.

The cleaning device 34 includes the cleaning case 341 which accommodates the remaining toner and which has an opening facing the photoreceptor drum 31, and in the cleaning device 34, the cleaning blade 342 which is disposed to come in contact with the photoreceptor drum 31 is attached to the lower edge of the opening of the cleaning case 341 through a bracket (not shown). Meanwhile, the film seal 344 which is held air tightly with respect to the photoreceptor drum 31 is attached to the upper edge of the opening of the cleaning case 341. In addition, reference numeral 345 denotes a transporting member which guides waste toner accommodated in the cleaning case 341 to a waste toner container on the side.

Next, the cleaning blade provided on the cleaning device 34 will be described in detail with reference to the drawing.

FIG. 1 is a schematic cross-sectional view showing an example of the cleaning blade of the exemplary embodiment, and is a view showing the cleaning blade 342 shown in FIG. 5 and the photoreceptor drum 31 which comes in contact therewith.

In addition, in the exemplary embodiment, in all cleaning devices 34 of respective image forming units 22 (22*a* to 22*d*), the cleaning blade of the exemplary embodiment is used as the cleaning blade 342, and the cleaning blade of the exemplary embodiment may be used for the cleaning blade 531 used in the belt cleaning device 53.

In addition, as shown in FIG. 5, for example, the developing unit (developing device) 33 used in the exemplary embodiment includes the unit case 331 which accommodates a developer and has an opening facing the photoreceptor drum 31. Herein, the developing roller 332 is disposed on the portion which faces the opening of the unit case 331, and toner transporting members 333 for stirring and transporting the developer are disposed in the unit case 331. Moreover, the transporting paddle 334 may be disposed between the developing roller 332 and the toner transporting member 333.

When developing, after supplying the developer to the developing roller 332, the developer is transported to a developing area facing the photoreceptor drum 31 in a state where the layer thickness of the developer is regulated in the developer quantity regulating member 335, for example.

In the exemplary embodiment, as the developing unit 33, a two-component developer formed of toner and a carrier, for example, is used; but, a single-component developer formed only of the toner may be used.

Next, an operation of the image forming apparatus of the exemplary embodiment will be described. First, when respective image forming units 22 (22*a* to 22*d*) form single-colored toner images corresponding to each color, the single-colored toner images of each color are sequentially superimposed to the surface of the intermediate transfer belt 230 so as to match with original document information and subjected to primary transfer. Next, the colored toner images transferred to the surface of the intermediate transfer belt 230 are transferred to the surface of the recording medium in the secondary transfer unit 52, and the recording medium to which the colored toner image is transferred is subjected to a fixing process performed by the fixing device 66, and then, is discharged to the discharge unit 68.

Meanwhile, in the respective image forming units 22 (22*a* to 22*d*), the remaining toner on the photoreceptor drum 31 is cleaned by the cleaning device 34, and the remaining toner on the intermediate transfer belt 230 is cleaned by the belt cleaning device 53.

In such image forming process, each remaining toner is cleaned by the cleaning device 34 (or belt cleaning device 53).

In addition, the cleaning blade 342 may be fixed to a frame member in the cleaning device 34 with a spring material, other than being directly fixed thereto as shown in FIG. 5.

EXAMPLES

Hereinafter, the exemplary embodiment of the invention will be described in detail with Examples, but the invention is not limited only to the following examples. In addition, in the description below, a "part" refers to a "part by weight".

Manufacture of Cleaning Blade

Example 1

Cleaning Blade A1

1,10-decanediol (first polyol component) and 1,4-butanediol (second polyol component) are mixed with each other at a molar ratio of 65/35, and are subjected to dehydration condensation with adipic acid, to obtain polyester polyol.

After drying this under reduced pressure at 75° C. for 15 hours, 44 parts of 4,4'-diphenylmethane diisocyanate ("MILLIONATE MT" manufactured by Nippon Polyurethane Industry Co., Ltd.) is added with respect to 100 parts of polyester polyol so that mol % of NCO in a prepolymer is 7 mol %, and the resultant material is subjected to a reaction in a nitrogen atmosphere at 75° C. for 3 hours, to obtain a prepolymer.

Next, this prepolymer is heated to 100° C. and is subjected to defoaming for one hour under the reduced pressure. After that, 7.14 parts of mixture (weight ratio=60/40) of 1,4-butanediol and trimethylolpropane is added with respect to 100 parts of the prepolymer, and mixed for three minutes without foaming, and a cleaning blade forming composition A1 is prepared.

Then, the cleaning blade forming composition A1 is poured into the centrifugal molding machine in which a mold is adjusted to 140° C., and is subjected to the curing reaction for one hour. Next, the composition is subjected to aging heating at 110° C. for 24 hours, cooled, and then cut, to obtain a cleaning blade A1 having a length of 8 mm and a thickness of 2 mm.

Examples 2 to 9

Cleaning blade forming compositions A2 to A9 are prepared and cleaning blades A2 to A9 are manufactured in the same manner as in Example 1, except for obtaining polyester polyol by changing the materials and the molar ratio of the first diol component and the second diol component used in Example 1 to materials and molar ratios shown in Table 1 and Table 2.

Example 10

A cleaning blade A10 is manufactured in the same manner as in Example 1 except for obtaining a cleaning blade forming composition A10 by changing trimethylolpropane used in Example 1 to trimethylolethane.

Comparative Examples 1 to 3

Cleaning blade forming compositions B1 to B3 are prepared and cleaning blades B1 to B3 are manufactured in the same manner as in Example 1 except for changing the molar ratio of 1,10-decanediol to 1,4-butanediol used in Example 1 to molar ratios shown in Table 3.

Example 11

A cleaning blade forming composition A11 is prepared and a cleaning blade A11 is manufactured in the same manner as in Example 1 except for changing the cross-linking agent and the chain extender used in Example 1 to respective materials shown in Table 3.

Example 12

A cleaning blade forming composition A12 is prepared and a cleaning blade A12 is manufactured in the same manner as in Example 1 except for changing the chain extender used in Example 1 to a material shown in Table 3.

For the cleaning blades obtained in Examples, the following physical property evaluation of the contacting member, characteristics evaluation and image quality evaluation of the cleaning blade are performed. Results thereof are shown in Table 1 to Table 3.

Physical Property Evaluation

100% Modulus

100% modulus (stress at a given elongation) M is calculated at a tensile rate of 500 mm/min using a dumbbell-shaped No. 3 type test piece based on JIS-K6251, and is acquired by the stress at the time of 100% strain. In addition, strograph AE elastomer manufactured by Toyo Seiki Seisaku-Sho, Ltd. is used as the measuring device.

Tan δ Peak Temperature

For a Tan δ (loss tangent) peak temperature, a peak temperature (glass transition temperature) observed from a Tan δ curve is measured based on JISK 6394 (1998). DMS6100 manufactured by Seiko Instruments Inc. is used as a measuring device.

Characteristics Evaluation and Image Quality Evaluation of Cleaning Blade

Configuration of Image Forming Apparatus

The cleaning blades of Examples are mounted as cleaning blades for photoreceptor drums of an image forming apparatus (product name: DocuCentre-II C7500 manufactured by Fuji Xerox Co., Ltd.) shown in FIG. 4, respectively.

- Photoreceptor drum: organic photosensitive material (ϕ=30 mm)
- Process speed: three patterns of 250 mm/sec, 110 mm/sec, and 55 mm/sec
- Charging device: charging roll of superimposed alternating current on direct current
- Developing device: two-component magnetic brush developing device
- Cleaning blade: length of 320 mm, width of 12 mm, thickness of 2 mm, free length of 7.0 mm, contacting angle of 25 degrees, and pressing force NF of 2.0 gf/mm In the test, using toner obtained by the polymerization method, having shape factors distributed in a range from 123 to 128 and having an average particle size of 6 μm, a two-component developer including this toner is accommodated in the developing device of the image forming apparatus, and is used. By repeating the test printing (area ratio of 5% per 1 color) by the image forming apparatus on five sheets of the printing paper, the respective printing of 50,000 sheets is performed in the following environment. The stress environment is set to have a process speed of 250 mm/sec, high temperature and high humidity (32.5° C., 85% RH), low temperature and low humidity (5° C., 15% RH), and medium temperature and medium humidity (22° C., 55% RH).

Blade Damage Evaluation

After the test, presence or absence of edge cracks on the cleaning blade is observed and the evaluation is performed with the following evaluation criteria.

A: the photoreceptor contacting surface is observed by a laser microscope and no cracks are observed B: minute cracks are generated, but are not problematic for the image C: cracks are generated, and image failure such as vertical bars occurs Abrasion Resistance Evaluation The abrasion resistance of the cleaning blade is evaluated by the following method.

Image formation is performed by using A4-sized paper (210 mm×297 mm, P paper manufactured by Fuji Xerox Co., Ltd.) in the high temperature and high humidity environment (32.5° C., 85% RH), until the revolution number of the photoreceptor becomes 100 K cycles. After that, the abrasion depth on the (edge) tip of the contacting portion of the cleaning blade and the cleaning failure are evaluated, and the edge abrasion is determined. At the time of the test, since the evaluation is performed in harsh conditions with the small lubricating effect in the contacting portion of the photoreceptor and the cleaning blade, image density of the formed image is set to 1%. In addition, the abrasion depth of the edge tip is measured as the maximum depth of the edge missing portion on the photoreceptor surface side, which is checked from the cross section side of the cleaning blade at the time of observation by a laser microscope VK-8510 manufactured by Keyence Corporation.

Further, in the evaluation of the cleaning failure, after completing the test described above, the A3-sized paper on which a non-transfer solid image having image density of 100% (solid image size: 1400 mm×290 mm) is formed, is fed between the photoreceptor and the cleaning blade at a normal process speed, the apparatus is stopped immediately after the final end portion of the non-fixed image in the transportation direction passes through the contacting portion of the photoreceptor and the cleaning blade, and passing through of the toner is visually checked. The case in which the significant passing through is observed is determined as the cleaning failure. In addition, in a case where the portion for stopping the toner is missed by the abrasion or cracks on the edge tip, since the cleaning failure occurs more easily in the test described above as the edge abrasion depth or the crack depth becomes larger, the test is useful for the qualitative evaluation of the abrasion or cracks on the edge tip.

The evaluation criteria of the edge abrasion are shown below. In addition, the allowable range is A and B.

A: Abrasion depth of tip portion: equal to or less than 3 μm and no abrasion mark Cleaning failure: not occur B: Abrasion depth of tip portion: more than 3 μm and equal to or less than 5 μm Cleaning failure: not occur C: Abrasion depth of tip portion: more than 3 μm Cleaning failure: occur Image Quality Evaluation The cleaning blades of Examples and Comparative Examples obtained as described above are mounted as cleaning blades for the photoreceptor drums of a color copying machine (DocuCentre Color a450 manufactured by Fuji Xerox Co., Ltd.).

The formation of an image having the image density of 1% (solid image of 6.2 mm×1 mm is formed on the A4-sized sheet) is repeated 2,000 times on the sheets (C2r sheet manufactured by Fuji Xerox Co., Ltd.). The deformation degree of the cleaning blade after the image formation, and the occurrence state of the image quality failure of the color streak, are visually evaluated by the following criteria.

A: color streak is not confirmed

B: few color streaks are checked on an image but are in the allowable range

C: color streak is checked on an image and are not allowable.

TABLE 1

| | | Example 1 | Example 2 | Example 3 | Example 4 | Example 5 |
|---|---|---|---|---|---|---|
| Dicarboxylic acid | Kind | Adipic acid | Adipic acid | Adipic acid | Adipic acid | Adipic acid |
| Diol | First diol | 1,10-decanediol | 1,10-decanediol | 1,10-decanediol | 1,11-dodecanediol | 1,12-undecanediol |
| | Second diol | 1,4-butanediol | 1,4-butanediol | 1,4-butanediol | 1,4-butanediol | 1,4-butanediol |
| First diol/second diol (molar ratio) | | 65/35 | 50/50 | 80/20 | 65/35 | 65/35 |
| Molecular weight of polyester polyol | | 2010 | 2010 | 2010 | 2010 | 2010 |
| Isocyanate | | MDI | MDI | MDI | MDI | MDI |
| Cross-linking agent | | trimethylolpropane | trimethylolpropane | trimethylolpropane | trimethylolpropane | trimethylolpropane |
| Chain extender | | 1,4-butanediol | 1,4-butanediol | 1,4-butanediol | 1,4-butanediol | 1,4-butanediol |
| 100% modulus (MPa) | | 7.5 | 9 | 6 | 6.5 | 6 |
| Tanδ peak temperature | | −5 | 0 | −7 | −7 | −10 |
| Blade evaluation | Crack resistance property | A | B | A | A | A |
| | Abrasion resistance property | A | A | A | A | A |
| Image quality | | A | B | A | A | A |

TABLE 2

| | | Example 6 | Example 7 | Example 8 | Example 9 | Example 10 |
|---|---|---|---|---|---|---|
| Dicarboxylic acid | Kind | Adipic acid | Adipic acid | Adipic acid | Adipic acid | Adipic acid |
| Diol | First diol | 1,10-decanediol | 1,10-decanediol | 1,10-decanediol | 1,10-decanediol | 1,10-decanediol |
| | Second diol | 1,2-ethanediol | 1,5-pentanediol | 1,4-butanediol | 1,4-butanediol | 1,4-butanediol |
| First diol/second diol (molar ratio) | | 65/35 | 65/35 | 65/35 | 65/35 | 65/35 |
| Molecular weight of polyester polyol | | 2010 | 2010 | 1004 | 4065 | 2010 |
| Isocyanate | | MDI | MDI | MDI | MDI | MDI |
| Cross-linking agent | | trimethylolpropane | trimethylolpropane | trimethylolpropane | trimethylolpropane | trimethylolethane |
| Chain extender | | 1,4-butanediol | 1,4-butanediol | 1,4-butanediol | 1,4-butanediol | 1,4-butanediol |
| 100% modulus (MPa) | | 8.5 | 6.5 | 8 | 6.5 | 7 |
| Tanδ peak temperature | | −7 | 0 | −3 | −6 | −4.5 |
| Blade evaluation | Crack resistance property | A | B | A | A | A |
| | Abrasion resistance property | A | A | A | A | A |
| Image quality | | A | B | A | A | A |

TABLE 3

| | | Com. Ex. 1 | Com. Ex. 2 | Com. Ex. 3 | Example 11 | Example 12 |
|---|---|---|---|---|---|---|
| Dicarboxylic acid | Kind | Adipic acid | Adipic acid | Adipic acid | Adipic acid | Adipic acid |
| Diol | First diol | 1,10-decanediol | 1,10-decanediol | 1,10-decanediol | 1,10-decanediol | 1,10-decanediol |
| | Second diol | 1,4-butanediol | 1,4-butanediol | 1,4-butanediol | 1,4-butanediol | 1,4-butanediol |
| First diol/second diol (molar ratio) | | 90/10 | 10/90 | 40/60 | 65/35 | 65/35 |
| Molecular weight of polyester polyol | | 2010 | 2010 | 2010 | 2010 | 2010 |
| Isocyanate | | MDI | MDI | MDI | MDI | MDI |

TABLE 3-continued

| | | Com. Ex. 1 | Com. Ex. 2 | Com. Ex. 3 | Example 11 | Example 12 |
|---|---|---|---|---|---|---|
| Cross-linking agent | | trimethylolpropane | trimethylolpropane | trimethylolpropane | trimethylol | trimethylolpropane |
| Chain extender | | 1,4-butanediol | 1,4-butanediol | 1,4-butanediol | 1,3-propanediol | 1,6-hexanediol |
| 100% modulus (MPa) | | 4.5 | 8.5 | 9.5 | 6.5 | 7.5 |
| Tanδ peak temperature | | −17 | 2 | 4 | −6 | −3 |
| Blade evaluation | Crack resistance property | A | C | C | A | A |
| | Abrasion resistance property | C | A | A | A | A |
| Image quality | | C | C | C | A | A |

With the cleaning blade of Examples 1 to 12, cracks on the blades and abrasion loss are slight, and an excellent image is obtained.

With the cleaning blade of Comparative Example 1, it is considered that, since the rate of the second diol component is small and the modulus is low, the blade strain becomes large so as to cause a large contacting area of the blade and the photoreceptor, and abrasion loss is great.

With the cleaning blade of Comparative Example 2, it is considered that the rate of the first diol component is small, the Tan δ peak temperature is increased, the molecular movement property is degraded, and toughness is damaged so that the cracks occur.

With the cleaning blade of Comparative Example 3, it is considered that the Tan δ peak temperature is increased, the molecular movement property is degraded, and toughness is damaged so that the cracks occur.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A cleaning blade, comprising:

a portion which comes in contact with a member to be cleaned and which is configured of a member containing polyurethane rubber, comprising:

a structure derived from polyester polyol in which a first diol component having 10 or more carbon atoms and a second diol component having 5 or less carbon atoms are condensed with dicarboxylic acid at a molar ratio (first diol component/second diol component) of 50/50 to 80/20, a structure derived from polyisocyanate, and a structure derived from a triol.

2. The cleaning blade according to claim 1, wherein a 100% modulus of the member configuring the portion which comes in contact with a member to be cleaned is equal to or greater than 6 MPa and Tan δ peak temperature is equal to or lower than 0° C.

3. The cleaning blade according to claim 1, wherein a 100% modulus of the member configuring the portion which comes in contact with a member to be cleaned is equal to or greater than 6 MPa and Tan δ peak temperature is equal to or lower than −1° C.

4. The cleaning blade according to claim 3, wherein the Tan δ peak temperature is equal to or higher than −30° C.

5. The cleaning blade according to claim 1, wherein a 100% modulus of the member configuring the portion which comes in contact with a member to be cleaned is equal to or greater than 6 MPa and Tan δ peak temperature is equal to or lower than −5° C.

6. The cleaning blade according to claim 5, wherein the Tan δ peak temperature is equal to or higher than −15° C.

7. The cleaning blade according to claim 1, wherein the second diol component is at least one kind selected from a diol having 2 to 4 carbon atoms.

8. The cleaning blade according to claim 1, wherein a molar ratio (first diol component/second diol component) of the first diol component to the second diol component configuring polyester polyol is from 50/50 to 70/30.

9. The cleaning blade according to claim 1, wherein a molar ratio (first diol component/second diol component) of the first diol component to the second diol component configuring polyester polyol is from 50/50 to 65/35.

10. A cleaning device comprising the cleaning blade according to claim 1.

11. An image forming apparatus comprising:

an image holding member;

a charging device that charges the image holding member;

an electrostatic latent image forming device that forms an electrostatic latent image on a surface of a charged image holding member;

a developing device that develops the electrostatic latent image formed on the surface of the image holding member with toner to form a toner image;

a transfer device that transfers the toner image formed on the image holding member onto a recording medium; and the cleaning device according to claim 10 that brings the cleaning blade into contact with the surface of the image holding member for cleaning.

* * * * *